US009068389B2

(12) United States Patent
Cheng et al.

(10) Patent No.: US 9,068,389 B2
(45) Date of Patent: Jun. 30, 2015

(54) DAMPING HINGE DEVICE AND SUPPORT STRUCTURE HAVING THE SAME

(71) Applicant: JARLLYTEC CO., LTD., New Taipei (TW)

(72) Inventors: Kang-Han Cheng, New Taipei (TW); Kun-Yeh Lee, New Taipei (TW)

(73) Assignee: JARLLYTEC CO., LTD., New Taipei (TW)

( * ) Notice: Subject to any disclaimer, the term of this patent is extended or adjusted under 35 U.S.C. 154(b) by 0 days.

(21) Appl. No.: 14/161,510

(22) Filed: Jan. 22, 2014

(65) Prior Publication Data

US 2014/0223691 A1 Aug. 14, 2014

(30) Foreign Application Priority Data

Feb. 8, 2013 (TW) ..... 102203107 U

(51) Int. Cl.
*E05D 11/10* (2006.01)
*E05F 5/08* (2006.01)

(52) U.S. Cl.
CPC ..... *E05F 5/08* (2013.01); *Y10T 16/304* (2015.01); *E05Y 2900/606* (2013.01); *E05Y 2201/254* (2013.01)

(58) Field of Classification Search
CPC ..... E05D 11/02; E05D 11/06; E05D 11/10; E05F 3/20
USPC ..... 16/273, 274, 319, 340
See application file for complete search history.

(56) References Cited

U.S. PATENT DOCUMENTS

| | | | | |
|---|---|---|---|---|
| 4,485,522 | A * | 12/1984 | Chen | 16/54 |
| 5,774,939 | A * | 7/1998 | Lu | 16/342 |
| 5,826,307 | A * | 10/1998 | Chin-Fu | 16/340 |
| 6,286,187 | B1 * | 9/2001 | Chang | 16/340 |
| 6,297,946 | B2 * | 10/2001 | O'Neal et al. | 361/679.27 |
| 7,117,563 | B2 * | 10/2006 | Chen et al. | 16/330 |
| 7,143,476 | B2 * | 12/2006 | Minami | 16/340 |

FOREIGN PATENT DOCUMENTS

| | | |
|---|---|---|
| TW | M408921 | 8/2011 |
| TW | M422014 | 2/2012 |

* cited by examiner

*Primary Examiner* — Roberta Delisle
(74) *Attorney, Agent, or Firm* — Guice Patents PLLC

(57) ABSTRACT

The present invention relates to a damping hinge device, including a first core shaft, a first ring, a core shaft sleeve and a second ring; one end section of the first core shaft is formed as a connection part and installed a damping contact part; the first ring is sleeved on the first core shaft and positioned between the connection part and the damping contact part; one end section of the core shaft sleeve is concavely formed with an accommodation slot for accommodating the damping contact part, the viscous damping layer and the first ring; the second ring is sleeved on the first core shaft and combined with the core shaft sleeve, the second ring is served to cover the first ring for sealing the viscous damping layer thereby allowing the viscous damping layer to generate a viscous resistance to the damping contact part being in a rotating status.

17 Claims, 10 Drawing Sheets

DAMPING HINGE DEVICE AND SUPPORT STRUCTURE HAVING THE SAME

BACKGROUND OF THE INVENTION

1. Field of the Invention

The present invention relates to a damping hinge device, especially to a damping hinge device suitable to be used in a support structure of an all-in-one computer, or to a damping hinge device having a support structure; the mentioned all-in-one computer can be a frame-like display device which comprises the host hardware and conventional screen or touch screen by all-in-one, a digital photo frame, an electronic book, a tablet computer or other type of flat display or electronic device.

2. Description of Related Art

A conventional all-in-one computer utilizes a support structure (or a supporter structure, hereinafter both referred as a support structure), please refer to the Taiwan Patent No. M408921 titled in "Electronic device and support structure" and refer to the Taiwan Patent No. M422014 titled in "Support structure", one end section of the support structure is directly pivoted at the backside of a conventional all-in-one computer, and the other end section of the support structure is enabled to be rotated and unfolded, and matched with the bottom edge of the conventional all-in-one computer for being respectively abutted against an object (e.g. a table or a cabinet) thereby forming a standing status on the object or in the object, when the support structure is rotated and engaged with the conventional all-in-one computer, effects of easy to be stored and carried around are provided.

The location where the support structure and the conventional all-in-one computer being pivoted is often installed with a supporter (or a rotating rack) pivoted with a rotation shaft (or two rotation shafts), so the support structure is provided with effects of being rotated and unfolded or being rotated and engaged, each of the rotation shafts mainly includes a first cam surface (or a first couple part) combined at one end section of the support structure, a shaft core (or a insertion rod) having its end section inserted in the end section of the support structure, a cam member (or an abutting block) sleeved on the shaft core for being coordinately operated with the cam surface, a spring sleeved on the shaft core and abutted against the cam member, and a nut locked at another end section of the shaft core and abutted against the spring; the cam member (or the abutting block) is formed with a second cam surface (or a second couple part), the surface is formed with convex parts and concave parts capable of being mutually engaged or displaced relative to the first cam surface (or the first couple part); so after the first and the second cam surfaces (or the first and the second couple parts) of the supporter are displaced relative to each other, the elastic force provided by the spring forces the first and the second cam surfaces (or the first and the second couple parts) to be automatically engaged with each other, thereby driving the supporter to be rotated and engaged.

SUMMARY OF THE INVENTION

According to the two mentioned patents, for allowing the elastic force of the spring to be able to bear the weight of the conventional all-in-one computer and also able to force the cam member (or the abutting block) for enabling the supporter (or the rotating rack) to generate the effect of automatic rotation, a spring having a greater elastic force is often adopted, when the loaded weight is reduced or no weight is applied (e.g. when the conventional all-in-one computer being flatly disposed), the supporter (or the rotating rack) would be rapidly and automatically rotated which may cause accidents (e.g. the collision and danger caused by the supporter being rapidly engaged), the present invention is aimed to solve the mentioned shortages.

One primary objective of the present invention is to provide a damping hinge device, in which a viscous resistance is utilized for enabling a core shaft to slowly rotate.

Another objective of the present invention is to provide a damping hinge device, in which a connection member and a rotation shaft having automatic engaging function are installed, thereby allowing two core shafts to synchronously and slowly rotate, so the generated viscous resistance is able to buffer the elastic force of a spring installed on the rotation shaft, thereby forming an automatic slow engaging effect.

One another objective of the present invention is to provide a support structure having a damping hinge device, a viscous resistance generated by the damping hinge device is utilized for buffering the elastic force having automatic engaging function, so the support structure is provided with an automatic slow rotating effect and provide with an effect of relatively easier for unfolding and relatively harder for engaging.

For achieving said objectives, the present invention provides a damping hinge device and a support structure having the same, and three technical solutions are provided; the first technical solution of the present invention is to provide a damping hinge device, which includes: a first core shaft, one end section thereof is formed as a connection part, a damping contact part is formed on the first core shaft, a surface of the damping contact part is concavely formed with at least a groove and covered with a viscous damping layer; a first ring, sleeved on the first core shaft and positioned between the connection part and the damping contact part; a core shaft sleeve, one end section thereof is concavely formed with an accommodation slot for accommodating the damping contact part and the viscous damping layer of the first core shaft and the first ring; and a second ring, sleeved on the first core shaft and combined at a slot opening of the core shaft sleeve, the second ring is served to cover the first ring for sealing the viscous damping layer thereby allowing the viscous damping layer to generate a viscous resistance to the damping contact part being in a rotating status.

For achieving aforesaid objectives, the second technical solution of the present invention is to provide a damping hinge device, which includes: a connection member, one end thereof is formed with a first connection hole, the other end thereof is formed with a second connection hole; a first core shaft, one end section thereof is formed as a connection part mounted in the first connection hole, a damping contact part is formed on the first core shaft, a surface of the damping contact part is concavely formed with at least a groove and covered with a viscous damping layer; a first ring, sleeved on the first core shaft and positioned between the connection part and the damping contact part; a core shaft sleeve, one end section thereof is concavely formed with an accommodation slot for accommodating the damping contact part and the viscous damping layer of the first core shaft and the first ring; a second ring, sleeved on the first core shaft and combined at a slot opening of the core shaft sleeve, the second ring is served to cover the first ring for sealing the viscous damping layer thereby allowing the viscous damping layer to generate a viscous resistance to the damping contact part being in a rotating status; a second core shaft, one end section thereof is mounted in the second connection hole, thereby enabling the second core shaft and the first core shaft to synchronously rotate; and a brake mechanism, sleeved on the second core shaft and includes a fixed cam which is not rotated with the second core shaft, a mobile cam which is rotated with the second core shaft and an elastic unit abutted against the mobile cam and the connection member for being operated coordinately, so the mobile cam is affected by the viscous resistance for being smoothly rotated and displaced relative to the fixed cam or being smoothly and automatically engaged and positioned on the fixed cam.

For achieving aforesaid objectives, the third technical solution of the present invention is to provide a support structure having a damping hinge device, which includes: a connection member, one end thereof is formed with a first connection hole, the other end thereof is formed with a second connection hole; a first core shaft, one end section thereof is formed as a connection part mounted in the first connection hole, a damping contact part is formed on the first core shaft, a surface of the damping contact part is concavely formed with at least a groove and covered with a viscous damping layer; a first ring, sleeved on the first core shaft and positioned between the connection part and the damping contact part; a core shaft sleeve, one end section thereof is concavely formed with an accommodation slot for accommodating the damping contact part and the viscous damping layer of the first core shaft and the first ring; a second ring, sleeved on the first core shaft and combined at a slot opening of the core shaft sleeve, the second ring is served to cover the first ring for sealing the viscous damping layer thereby allowing the viscous damping layer to generate a viscous resistance to the damping contact part being in a rotating status; two second core shafts, one end section of one of the second core shafts is mounted in the second connection hole, thereby enabling the mentioned second core shaft and the first core shaft to synchronously rotate; a frame, two sides thereof are respectively formed with a frame arm, each of the second core shafts is respectively and axially fastened on each distal piece of the frame arm, thereby enabling the two second core shafts to synchronously rotate; two brake mechanisms, each of the brake mechanisms is sleeved on each of the second core shafts and includes a fixed cam which is not rotated with the second core shaft, a mobile cam which is rotated with the second core shaft and an elastic unit abutted against the mobile cam for being operated coordinately, so each of the mobile cams is affected by the viscous resistance for being smoothly rotated and displaced relative to each of the fixed cams or being smoothly and automatically engaged with each of the fixed cams; and two supporters, each of the two second core shafts is respectively passed and installed on each of the supporters, so each of the supporters is able to be respectively pivoted with each of the distal pieces of the frame arms, thereby enabling the frame to be smoothly and automatically rotated and unfolded till being positioned or smoothly rotated for being engaged.

Accordingly, the damping hinge device provided by the present invention has following advantages: a viscous resistance is generated for enabling the core shaft to slowly rotate; a spiral groove is formed on the peripheral surface of the core shaft for increasing the contact area with the viscous damping layer; a dual ring arrangement is provided for enhancing the sealing effect; a connection member is additionally provided for being axially connected to a rotation shaft having the automatic engaging function, thereby enabling the two core shafts to synchronously and slowly rotate, the generated viscous resistance is utilized for buffering the elastic force of the spring installed on the rotation shaft, thereby providing an automatic slow engaging effect; and the support structure utilizes the viscous resistance generated by the damping hinge device for buffering the elastic force with automatic engaging effect, so the support structure is provided with an automatic slow rotating effect and provided with an effect of relatively easier for unfolding and relatively harder for engaging; and with the detachable supporter, the assembly or disassembly is facilitated thereby providing more convenience in use.

DETAILED DESCRIPTION OF THE PREFERRED EMBODIMENT

Figure 1:
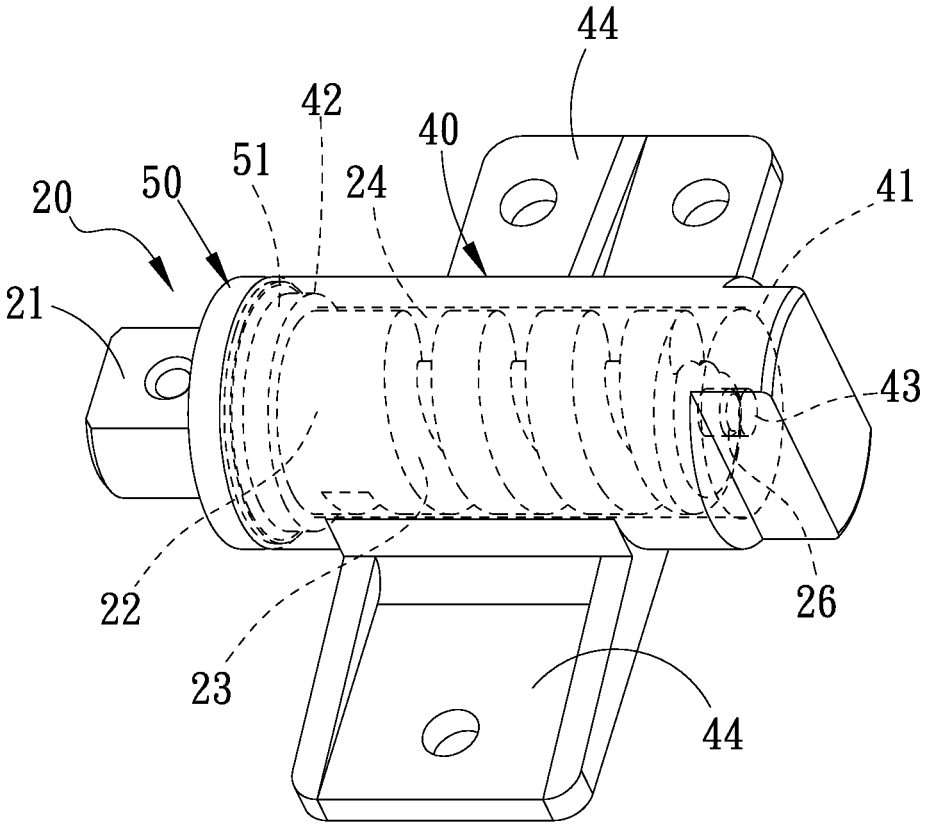
FIG. 1 is a perspective view according to the first embodiment of the present invention.
Figure 2:
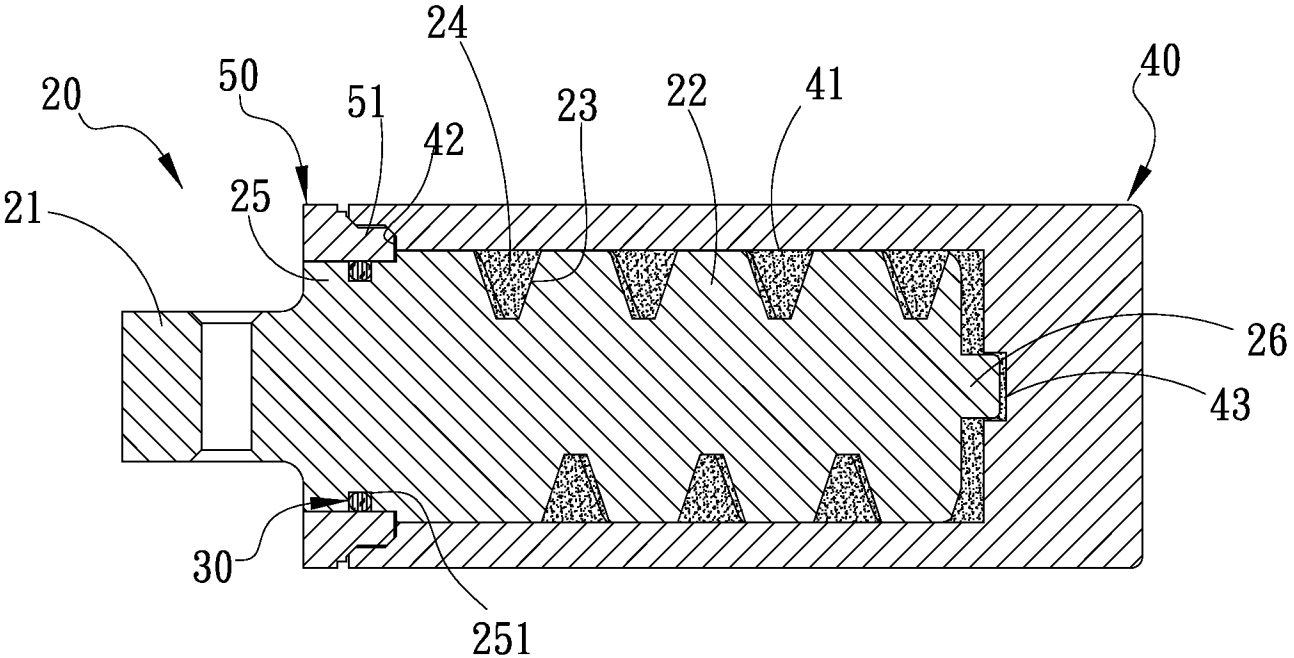
FIG. 2 is a cross sectional enlarged view of FIG. 1.
Figure 3:
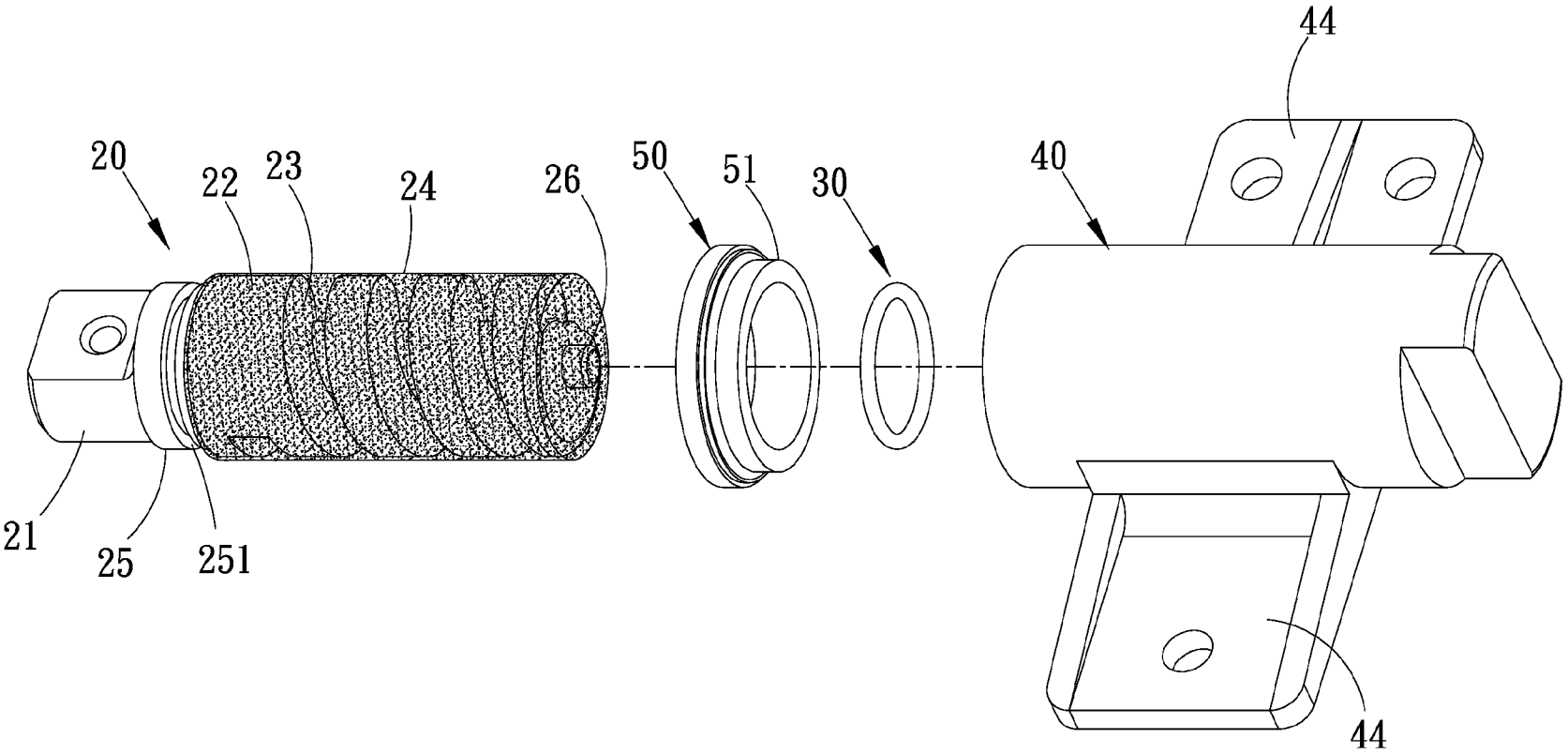
FIG. 3 is a perspective exploded view of FIG. 1.

Referring from FIG. 1 to FIG. 3, according to the first embodiment provided by the present invention, the damping hinge device includes a first core shaft 20, a first ring 30, a core shaft sleeve 40 and a second ring 50. One end section of the first core shaft 20 is formed as a connection part 21, and a damping contact part 22 is formed on the first core shaft 20, a surface of the damping contact part 22 is concavely formed with at least a groove 23 and covered with a viscous damping layer 24. The first ring 30 is sleeved on the first core shaft 20 and positioned between the connection part 21 and the damping contact part 22. One end section of the core shaft sleeve 40 is concavely formed with an accommodation slot 41 for accommodating the damping contact part 22 and the viscous damping layer 24 of the first core shaft 20 and the first ring 30. The second ring 50 is sleeved on the first core shaft 20 and combined at a slot opening of the core shaft sleeve 40, and the second ring 50 is served to cover the first ring 30 for sealing the viscous damping layer 24 thereby allowing the viscous damping layer 24 to generate a viscous resistance to the damping contact part 22 being in a rotating status so as to achieve an effect of slowing the rotating motion.

According to the first embodiment, the damping hinge device further includes a connection member 10 formed with a first connection hole 12, the connection part 21 of the first core shaft 20 is mounted in the first connection hole 12; the connection member 10 is formed as a tubular body in which an accommodation part 11 is formed, the first connection hole 12 is formed at one end of the tubular body and communicated with the accommodation part 11, the other end of the tubular body is formed with an opening 13 communicated with the accommodation part 11, plural concave parts 131 are annularly formed and arranged with intervals at the periphery of the opening 13 thereby forming plural tenons at the periphery of the opening 13, so the connection member 10 is enabled to be directly inserted into a corresponding structure of a conventional supporter (e.g. plural corresponding holes annularly formed on the conventional supporter) through the plural tenons, more operation convenience is therefore provided.

Figure 5:
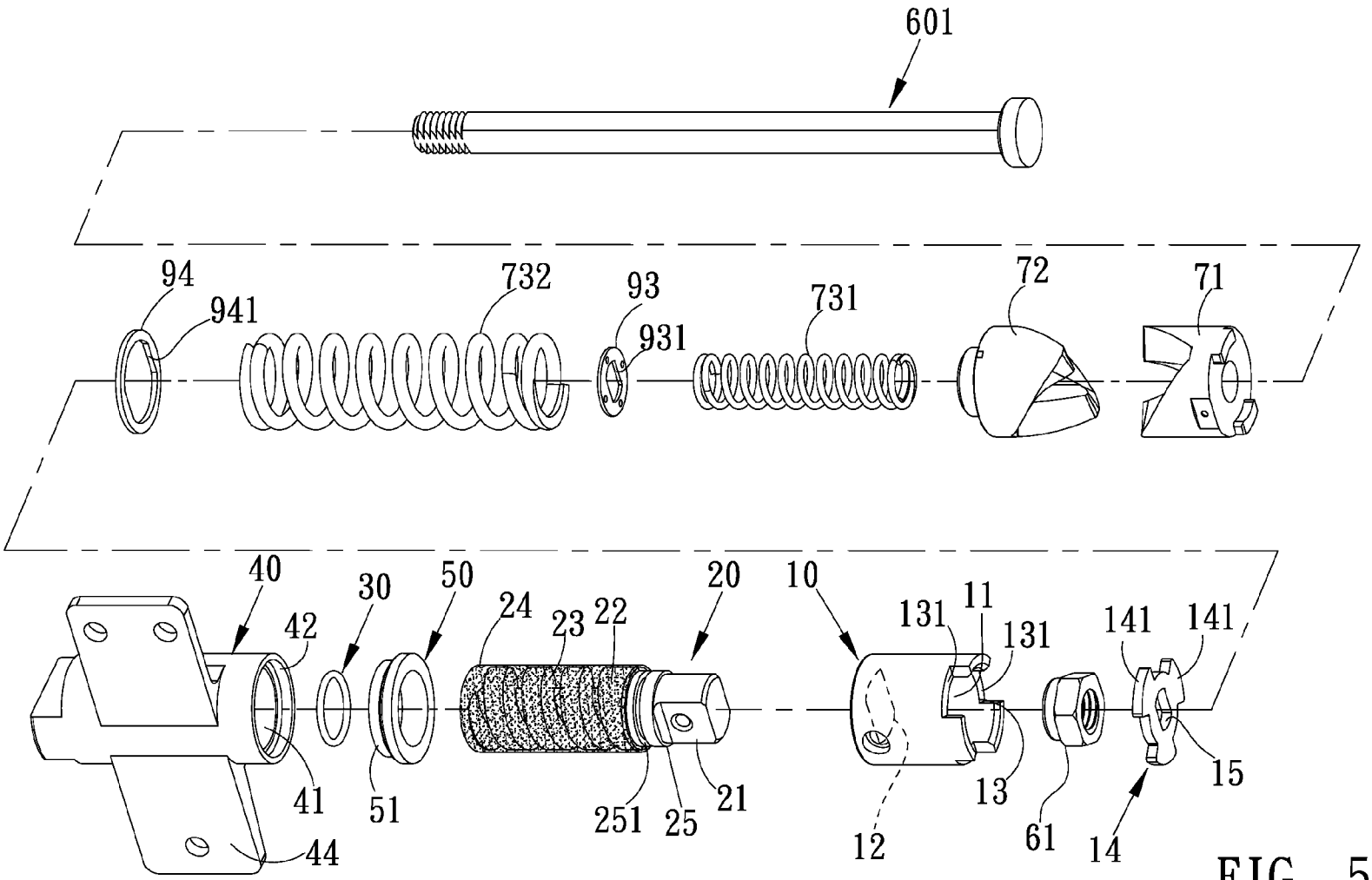
FIG. 5 is a perspective exploded view of FIG. 4.

The connection member 10 is provided with a fasten sheet 14 at the location corresponding to the opening 13, the fasten sheet 14 is formed with a second connection hole 15, and plural convex parts 141 are annularly formed and arranged with intervals at the periphery of the fasten sheet 14, the convex parts 141 are correspondingly mounted in the concave parts 131, thereby enabling the connection member 10 to be connected to a rotation shaft through the fasten sheet 14 (referring to FIG. 5 disclosed in the second embodiment provided by the present invention).

As shown in FIG. 2 and FIG. 3, a positioning part 25 used for positioning the second ring 50 is formed between the connection part 21 and the damping contact part 22 of the first core shaft 20, the positioning part 25 is concavely formed with a positioning groove 251 used for positioning the first ring 30, the slot opening of the accommodation slot 41 of the core shaft sleeve 40 is formed with an annular slot 42, the inner edge of the second ring 50 is formed with an annular flange 51 mounted in the annular slot 42 and covered the first ring 30, thereby forming a dual ring sealing effect for preventing leakage, and the core shaft sleeve 40 and the second ring 50 are able to be mutually combined for forming an integral structure thereby enhancing the sealing effect and preventing the first core shaft 20 from being loosened; in the first core shaft 20, the diameter of the connection part 21 is smaller than that of the positioning part 25, the diameter of the positioning part 25 is smaller than that of the damping contact part 22, so the configuration of the first core shaft 20 is formed as having larger dimension at the damping contact part 22 and gradually reduced towards the connection part 21; the outer periphery of the second ring 50 can be formed in a stepped status for being provided with more dimensions suitable to be correspondingly mounted with annular slot 42.

Figure 6:
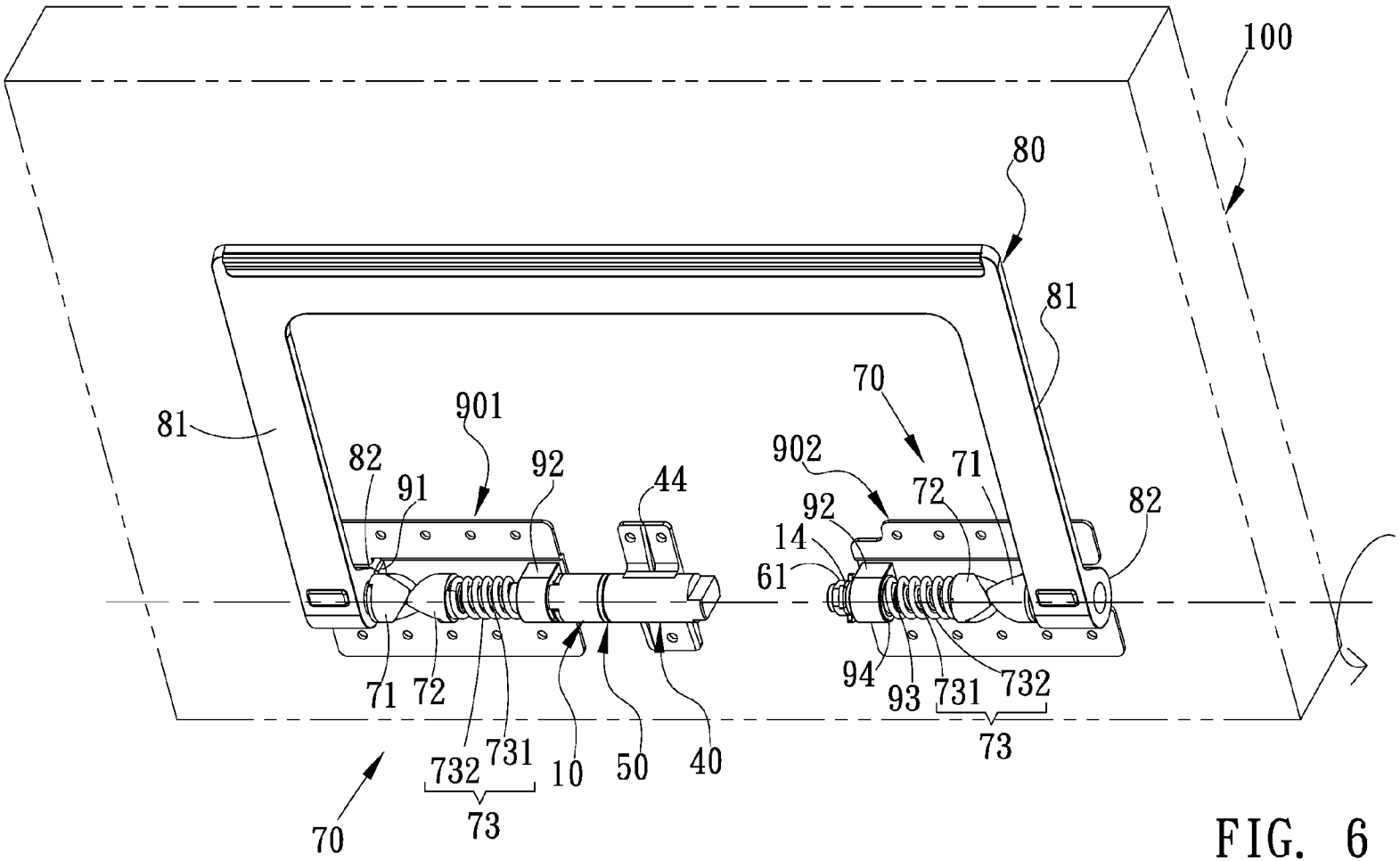
FIG. 6 is a perspective view according to the third embodiment of the present invention.

The other end section of the first core shaft 20 is axially extended with a convex column 26, an inner bottom surface of the accommodation slot 41 of the core shaft sleeve 40 is formed with a concave slot 43 axially connected the convex column 26 thereby enabling the first core shaft 20 to stably rotate and avoiding oblique rotation; the periphery of the core shaft sleeve 40 is radially formed with at least a fasten structure 44 (e.g. a lateral wing sheet) for being fastened on a wall surface of a all-in-one computer 100 (as shown in FIG. 6).

In the core shaft sleeve 40, for enabling the viscous damping layer 24 to cover the damping contact part 22 in the rotating status, the at least one groove 23 is formed as a spiral groove surrounding the peripheral surface of the damping contact part 22, or the spiral groove is formed as encircling from one end of the damping contact part 22 to the other end, thereby increasing the contact surface between the viscous damping layer 24 and the peripheral surface of the damping contact part 22.

Figure 4:
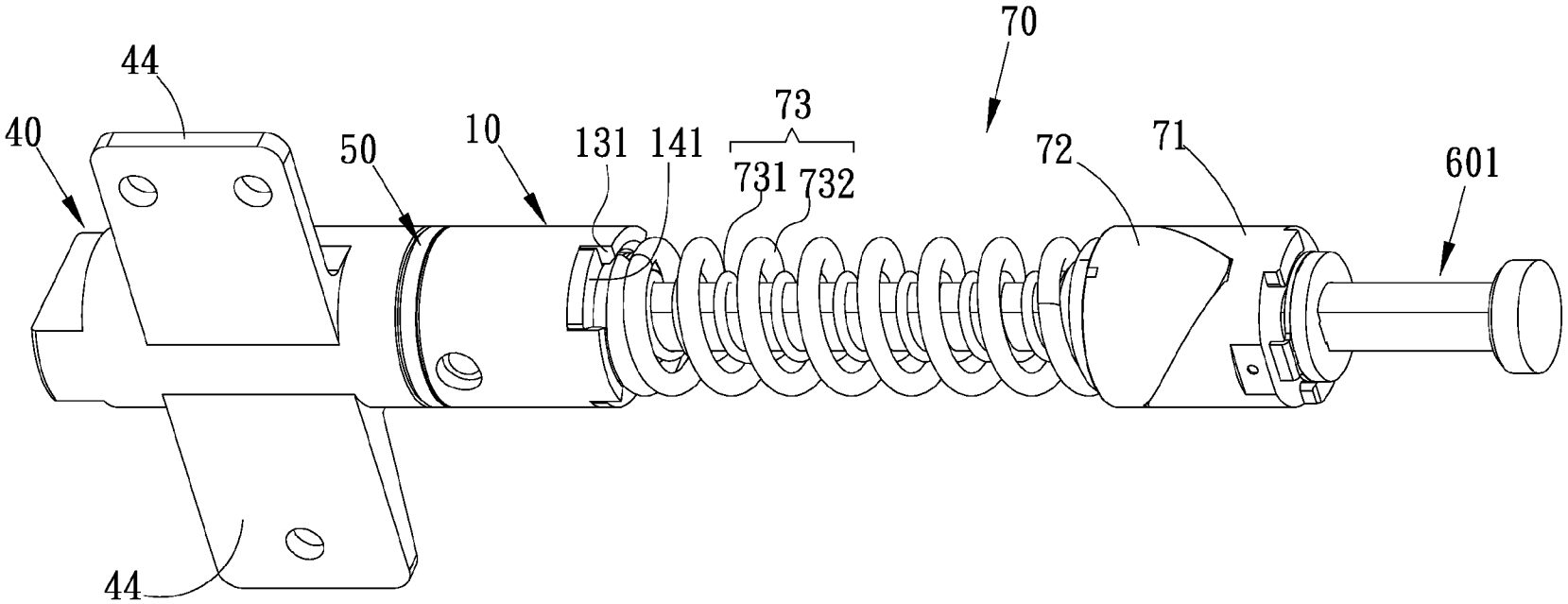
FIG. 4 is a perspective view according to the second embodiment of the present invention.
Figure 7:
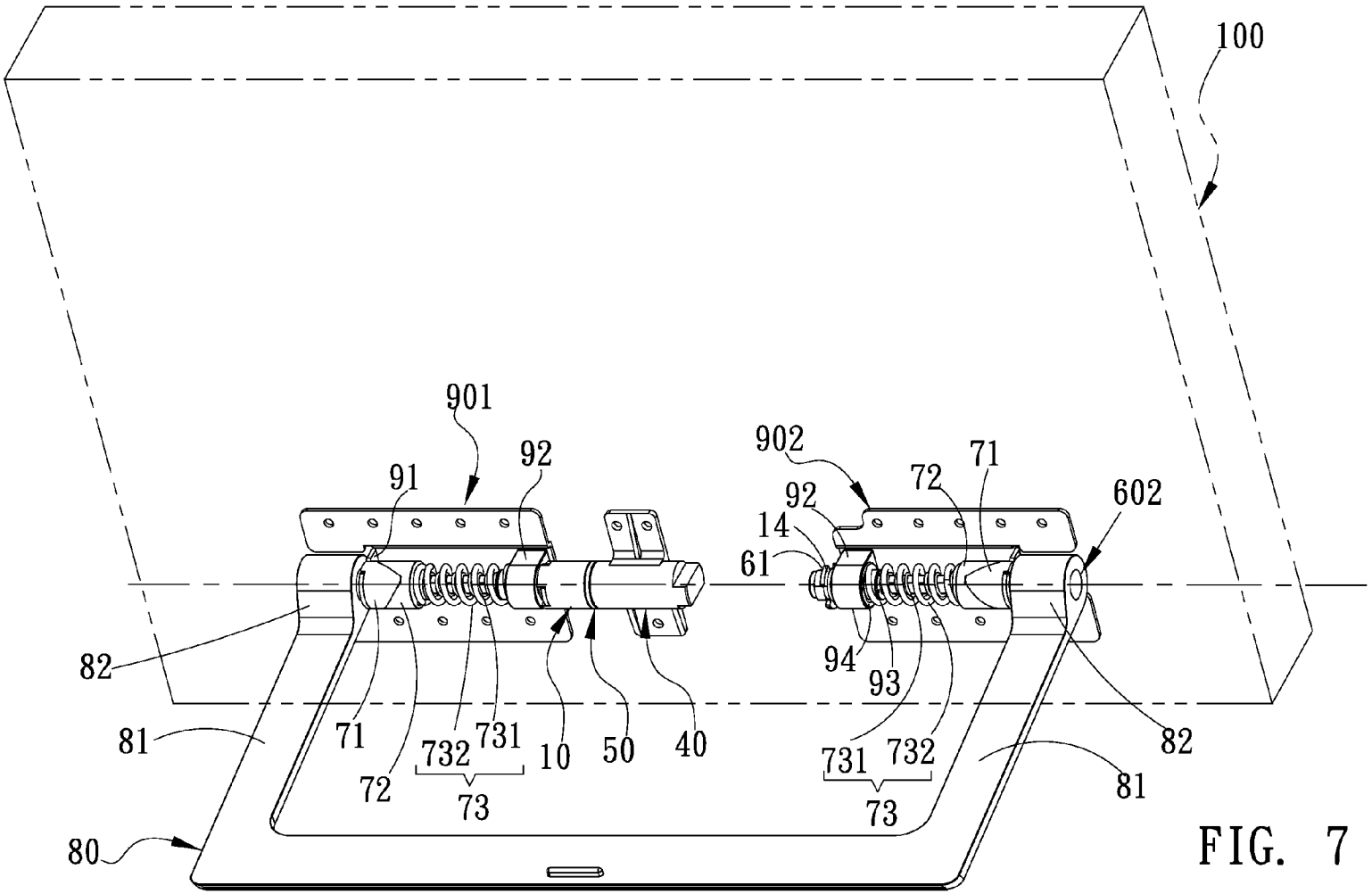
FIG. 7 is a schematic view illustrating the frame shown in FIG. 6 being rotated and unfolded.
Figure 8:
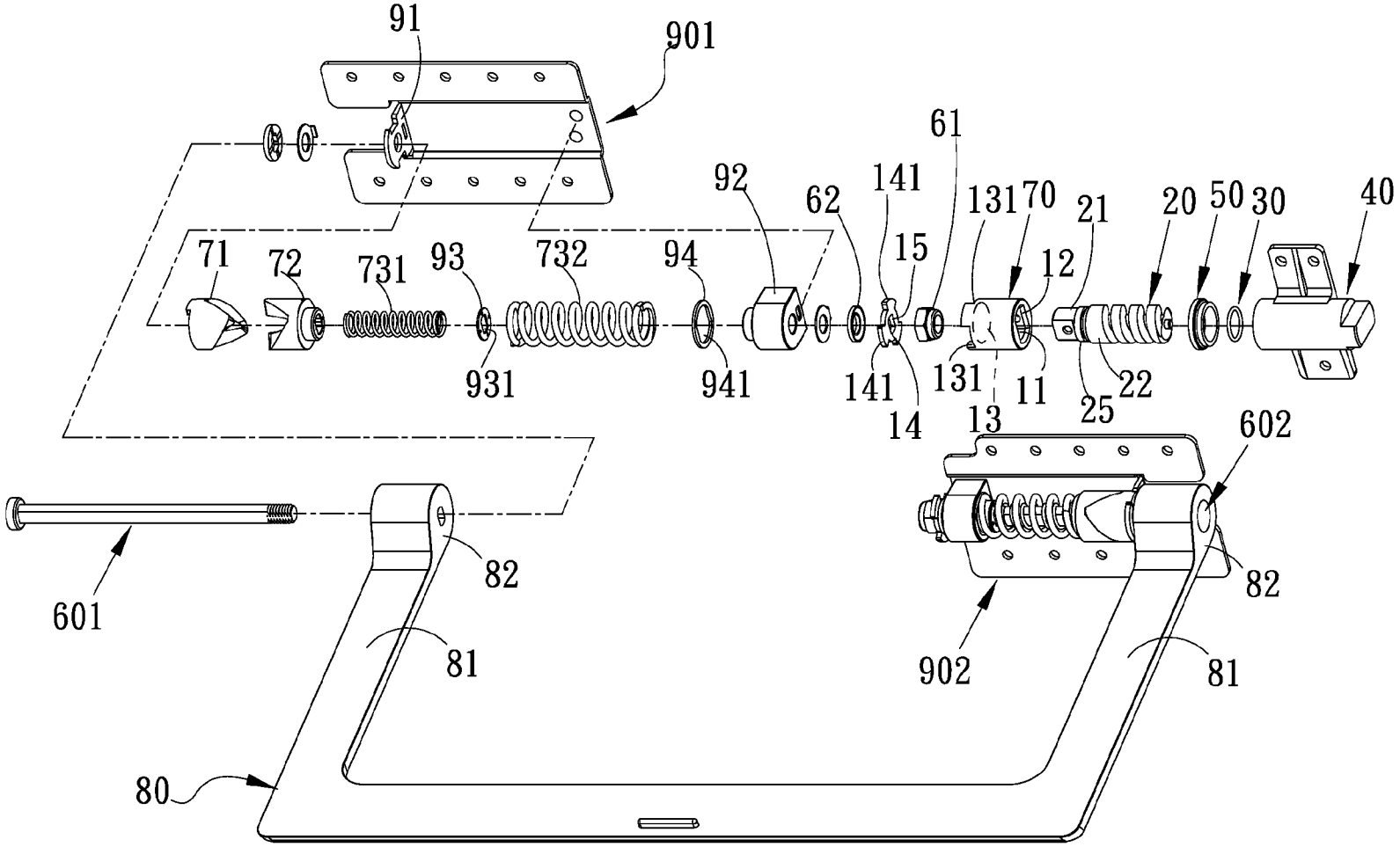
FIG. 8 is a partial exploded view illustrating the damping hinge device shown in FIG. 7 and the support structure.
Figure 9:
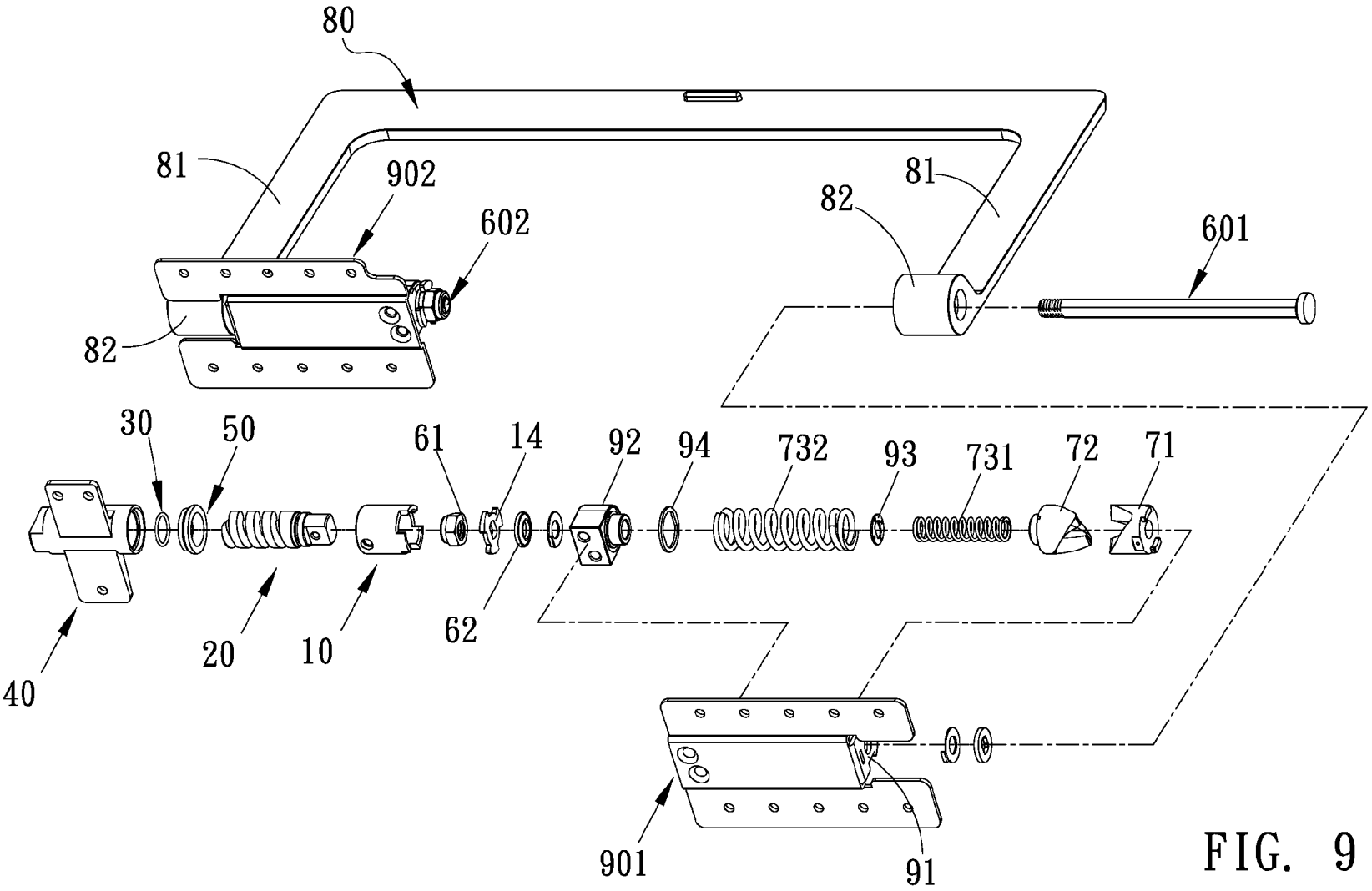
FIG. 9 is a schematic view of FIG. 8 being viewed from another angle.

As shown in FIG. 4 and FIG. 5, according to the second embodiment provided by the present invention, the difference between the first embodiment and the second embodiment is that: the damping hinge device disclosed in the second embodiment further includes a second core shaft 601 and a brake mechanism 70, and the other end of the connection member 10 is formed with a second connection hole 15, one end section of the second core shaft 601 is mounted in the second connection hole 15, thereby enabling the second core shaft 601 and the first core shaft 20 to synchronously rotate; the brake mechanism 70 is provided on the second core shaft 601 and includes a fixed cam 71 which is not rotated with the second core shaft 601, a mobile cam 72 which is rotated with the second core shaft 601 and an elastic unit 73 abutted against the mobile cam 72 and the connection member 10 for being operated coordinately, so the mobile cam 72 is affected by the viscous resistance for being smoothly rotated and displaced relative to the fixed cam 71 (as shown in FIG. 6) or being smoothly and automatically engaged with the fixed cam 71 (as shown in FIG. 7).

According to the second embodiment, the damping contact part 22 of the first core shaft 20 is formed in a columnar shape, the connection part 21 of the first core shaft 20 and the second core shaft 601 are both formed in a non-columnar shape (as shown in FIG. 5), for achieving the synchronous rotating motion, the shapes of the first and the second connection holes 12, 15 are respectively corresponding to the shapes of the connection part 21 and the second core shaft 601, and the second connection hole 15 and the first connection hole 12 correspondingly mounted are both formed in a non-circular shape and located at the same axial line, thereby allowing the first core shaft 20 and the second core shaft 601 to be coaxially arranged.

The connection member 10 is formed as a tubular body having an accommodation part 11 therein, the first connection hole 12 is formed at one end of the tubular body and communicated with the accommodation part 11, the accommodation part 11 is formed with an opening 13 at the other end of the tubular body, the tubular body is provided with a fasten sheet 14 at the location corresponding to the opening 13, the second connection hole 15 is formed on the fasten sheet 14, so with the connection member 10 working with the fasten sheet 14, effects of easy assembly, detachment and replacement are provided, and the connection member 10 can be formed with common components for expanding the applicable range of the present invention. The elastic unit 73 includes a first spring 731 sleeved on the second core shaft 601 and a second spring 732 having the first spring 731 sleeved therein, thereby increasing the elastic force through the dual spring arrangement.

The connection member 10 is formed with plural concave parts 131 arranged with intervals at the periphery of the opening 13, the fasten sheet 14 is formed with plural convex parts 141 arranged with intervals at the periphery thereof, the convex parts 141 are correspondingly mounted in the concave parts 131, thereby allowing the fasten sheet 14 to be mounted at the opening 13 of the accommodation part 11 and prevented from being loosened; one end section of the second core shaft 601 is passed the second connection hole 15 and the end section is formed with a position adjusting member 61 (as shown in FIG. 5), with a screw fitting manner, the position adjusting member 61 is disposed in the accommodation part 11 and abutted against one side of the fasten sheet 14, the elastic unit 73 is abutted against the opposite side of the fasten sheet 14, thereby enabling the connection member 10 to be adjustably positioned on the second core shaft 601.

Referring from FIG. 6 to FIG. 10, which disclose the third embodiment of the present invention, the difference between the third embodiment and the second embodiment is that: the damping hinge device disclosed in the third embodiment further includes a frame 80 and two supporters 901, 902, and two second core shafts 601, 602 and two brake mechanisms 70 are adopted, wherein one end section of the second core shaft 601 is mounted in the second connection hole 15 thereby enabling the second core shaft 601 and the first core shaft 20 to synchronously rotate; two sides of the frame 80 are respectively formed as a frame arm 81, each of the second core shafts 601, 602 is respectively and axially fastened on each distal piece 82 of the frame arm 81, thereby enabling the two second core shafts 601, 602 to synchronously rotate. Each of the brake mechanisms 70 is respectively sleeved on each of the second core shafts 601, 602, and includes a fixed cam 71 which is not rotate with the second core shaft, a mobile cam 72 which is rotated with the second core shaft, and an elastic unit 73 abutted against the mobile cam 72 for being operated coordinately; in other words, the above-mentioned is the components disclosed in the second embodiment being additionally provided a second core shaft 602 having the same structure and a brake mechanism 70 sleeved on the second core shaft 602, and the frame 80 is combined with the two second core shafts 601, 602, so the effect of synchronous rotating motion can still be provided; according to the present invention, each of the two second core shafts 601, 602 is respectively passed and installed on each of the supporters 901, 902, so each of the supporters 901, 902 is able to be respectively pivoted with each of the distal pieces 82 of the frame arms 81, thereby enabling the frame 80 to be smoothly and automatically rotated and unfolded till being positioned (as shown in FIG. 7) or smoothly rotated for being engaged (as shown in FIG. 6).

According to the third embodiment and referring from FIG. 6 to FIG. 9, each of the supporters 901, 902 is respectively formed with two pivotal parts 91, 92, each of second core shafts 601, 602 is respectively passed and installed in the two pivotal parts 91, 92 of each of the supporters 901, 902 and in the fixed cam 71, the mobile cam 72 and the elastic unit 73 disposed between the two pivotal parts 91, 92; each of the fixed cams 71 is respectively fastened on one pivotal part 91 of each of the supporters 901, 902, the other pivotal part 92 of each of the supporters 901, 902 is respectively stacked with at least a friction pad 93, 94 formed with a non-circular hole 931, 941, each of the elastic units 73 is respectively disposed between each of the friction pads 93, 94 and each of the mobile cams 72, each of the second core shafts 601, 602 is respectively passed the non-circular hole 931, 941 of each of the friction pads 93, 94, and one end section of each of the second core shafts 601, 602 is respectively provided with a position adjusting member 61, wherein the mentioned end section of the second core shaft 601 is passed the second connection hole 15 thereby allowing the position adjusting member 61 to be disposed in the accommodation part 11 and abutted against one side of the fasten sheet 14, an elastic disk 62 is disposed between the opposite side of the fasten sheet 14 and the other pivotal part 92 of the supporter 901 thereby allowing the connection member 10 to be adjustably positioned on the second core shaft 601, and each of the elastic units 73 includes a first spring 731 sleeved on the second core shaft 601, 602 and a second spring 732 having the first spring 731 sleeved therein; with the installation of the two supporters 901, 902, after the present invention is assembled, the present invention is able to be rapidly installed on a wall surface of a all-in-one computer 100, and after the frame 80 is unfolded, the frame 80 is able to support the all-in-one computer 100 for standing, and each of the supporters 901, 902 can be served to separate each of the elastic units 73 and the elastic disk 62 for preventing from interfering with each other.

Figure 10:
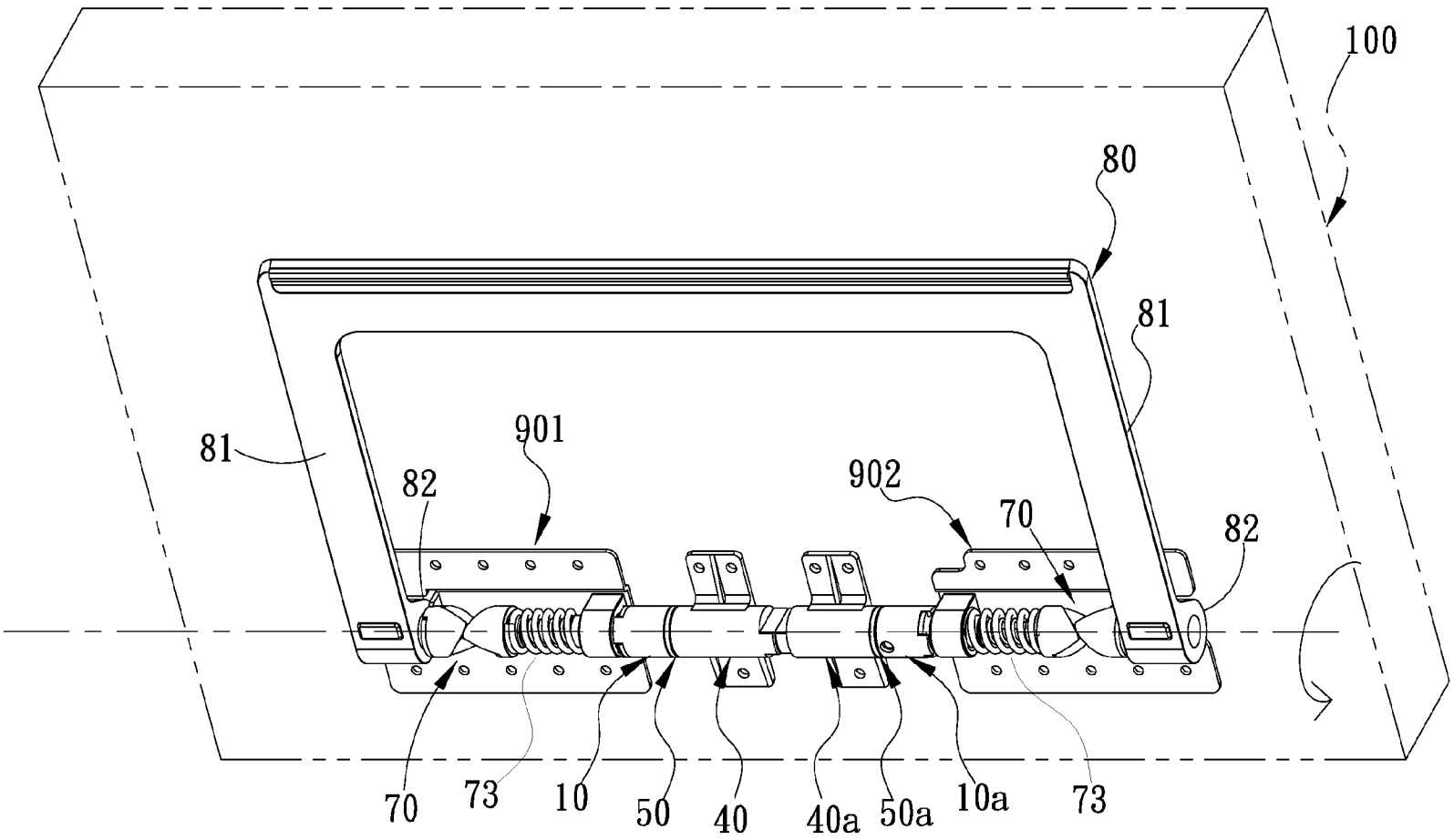
FIG. 10 is a schematic view illustrating FIG. 6 being additionally provided with another damping hinge device according to the third embodiment of the present invention.

In addition, according to the third embodiment, the quantity of the damping hinge device is no limited to be singular, as shown in FIG. 10, two damping hinge devices disclosed in the first embodiment are adopted and disposed between two second core shafts, the two damping hinge devices are symmetrically arranged, in other words one end section of the core shaft sleeve 40 is further symmetrically provided with another core shaft sleeve 40*a*, another first core shaft, another first ring, another second ring 50*a* and another connection member 10*a*, so the two second core shafts are respectively mounted with the connection member 10 and the another connection member 10*a*, thereby allowing each of the second core shafts and each of the first core shafts being coaxially arranged, the two damping hinge devices disclosed in the first embodiment are enabled to individually generate the viscous resistance for respectively corresponding to the elastic force of the two elastic units 73, thereby enhancing the buffering effect; the two damping hinge devices disclosed in the first embodiment cannot only be respectively disposed at the opposite sides of each of the distal pieces 82 of the frame arms 81 (i.e. the inner side of each of the distal pieces 82 of the frame arms 81), the two damping hinge devices disclosed in the first embodiment can also be disposed at different sides of each of the distal pieces 82 of the frame arms 81 (i.e. the outer side of each of the distal pieces 82 of the frame arm 81); the two core shaft sleeves 40, 40*a* can be integrally formed for reducing the amount of components and the operating procedure; each of the second core shafts can be respectively fastened on each of the distal pieces 82 of the frame arms 81 through an insert molding manner.

According to the second and the third embodiments, the contact surfaces of the mobile cam 72 and the fixed cam 71 are both formed with two convex parts and two concave parts capable of mutually mounted, during the process of each of the convex parts sliding in or out of each of the concave parts, the motions of sliding in and out are both affected by the viscous resistance, so during the process of the frame 80 being rotated and unfolded, the mobile cam 72 is pressed by the elastic force provided by each of the elastic units 73, the two convex parts of the mobile cam 72 are abutted against the two convex parts of the fixed cam 71 (as shown in FIG. 6), then automatically and smoothly slid in the two concave parts of the fixed cam 71 for being mounted and positioned (as shown in FIG. 7), thereby providing a smooth and automatic engaging effect, and the viscous resistance is able to be served to allow the frame 80 to support the all-in-one computer 100 for standing; and during the process of the frame 80 being rotated and engaged, an external force greater than the viscous resistance and the elastic force has to be applied for allowing the two convex parts of the mobile cam 72 to smoothly slide out of the two concave parts of the fixed cam 71 then slide to the two convex parts of the fixed cam 71, so the mobile cam 72 is able to be smoothly rotated and displaced relative to the fixed cam 71 thereby forming a mutual abutting status and providing an effect of relatively easier for unfolding and relatively harder for engaging.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

What is claimed is:

1. A damping hinge device, including:

a first core shaft, one end section thereof being formed as a connection part, a damping contact part being formed on said first core shaft, a surface of said damping contact part being concavely formed with at least a groove and covered with a viscous damping layer;

a first ring, sleeved on said first core shaft and positioned between said connection part and said damping contact part;

a core shaft sleeve, one end section thereof being concavely formed with an accommodation slot for accommodating said damping contact part and said viscous damping layer of said first core shaft and said first ring;

a second ring, sleeved on said first core shaft and combined at a slot opening of said core shaft sleeve, said second ring being served to cover said first ring for sealing said viscous damping layer thereby allowing said viscous damping layer to generate a viscous resistance to said damping contact part being in a rotating status, and a connection member formed with a first connection hole, said connection part of said first core shaft is mounted in said first connection hole, said connection member is formed as a tubular body in which an accommodation part is formed, said first connection hole is formed at one end of said tubular body and communicated with said accommodation part, the other end of said tubular body is formed with an opening communicated with said accommodation part, plural concave parts are annularly formed and arranged with intervals at the periphery of said opening.

2. The damping hinge device as claimed in claim 1, wherein said connection member is provided with a fasten sheet at the location corresponding to said opening, said fasten sheet is formed with a second connection hole, and plural convex parts are annularly formed and arranged with intervals at the periphery of said fasten sheet, said convex parts are correspondingly mounted in said concave parts.

3. The damping hinge device as claimed in claim 1, further comprising:

said connection member, one end thereof being formed with said first connection hole, the other end thereof being formed with a second connection hole;

a second core shaft, one end section thereof being mounted in said second connection hole, thereby enabling said second core shaft and said first core shaft to synchronously rotate; and a brake mechanism, sleeved on said second core shaft and including a fixed cam not rotated with said second core shaft, a mobile cam rotated with said second core shaft and an elastic unit abutted against said mobile cam and said connection member for being operated coordinately, so said mobile cam being affected by the viscous resistance for being smoothly rotated and displaced relative to said fixed cam or being smoothly and automatically engaged and positioned on said fixed cam.

4. The damping hinge device as claimed in claim 3, wherein said damping contact part of said first core shaft is formed in a columnar shape, said connection part of said first core shaft and said second core shaft are both formed in a non-columnar shape, said second connection hole and said first connection hole are both formed in a non-circular shape and located at the same axial line, thereby allowing said first core shaft and said second core shaft to be coaxially arranged.

5. The damping hinge device as claimed in claim 3, wherein said accommodation part is formed with an opening at the other end of said tubular body, said second connection hole is formed on said fasten sheet; said elastic unit includes a first spring sleeved on said second core shaft and a second spring having said first spring sleeved therein.

6. The damping hinge device as claimed in claim 5, wherein said fasten sheet is formed with plural convex parts arranged with intervals at the periphery thereof, said convex parts are correspondingly mounted in said concave parts, thereby allowing said fasten sheet to be mounted at said opening of said accommodation part; one end section of said second core shaft is passed said second connection hole and said end section is formed with a position adjusting member, said position adjusting member is disposed in said accommodation part and abutted against one side of said fasten sheet, said elastic unit is abutted against the opposite side of said fasten sheet, thereby enabling said connection member to be adjustably positioned on said second core shaft.

7. The damping hinge device as claimed in claim 3, wherein a positioning part used for positioning said second ring is formed between said connection part and said damping contact part of said first core shaft, said positioning part is concavely formed with a positioning groove used for positioning said first ring, said slot opening of said accommodation slot of said core shaft sleeve is formed with an annular slot, the inner edge of said second ring is formed with an annular flange mounted in said annular slot and covered said first ring.

8. The damping hinge device as claimed in claim 3, wherein said at least one groove of said first core shaft is formed as a spiral groove surrounding the peripheral surface of said damping contact part; the other end section of said first core shaft is axially extended with a convex column, an inner bottom surface of said accommodation slot of said core shaft sleeve is formed with a concave slot axially connected said convex column; the periphery of said core shaft sleeve is radially formed with at least a fasten structure.

9. The damping hinge device as claimed in claim 1, wherein a positioning part used for positioning said second ring is formed between said connection part and said damping contact part of said first core shaft, said positioning part is concavely formed with a positioning groove used for positioning said first ring, said slot opening of said accommodation slot of said core shaft sleeve is formed with an annular slot, the inner edge of said second ring is formed with an annular flange mounted in said annular slot and covered said first ring.

10. The damping hinge device as claimed in claim 1, wherein said at least one groove of said first core shaft is formed as a spiral groove surrounding the peripheral surface of said damping contact part; the other end section of said first core shaft is axially extended with a convex column, an inner bottom surface of said accommodation slot of said core shaft sleeve is formed with a concave slot axially connected said convex column; the periphery of said core shaft sleeve is radially formed with at least a fasten structure.

11. The damping hinge device as claimed in claim 1, further comprising:

said connection member, one end thereof being formed with said first connection hole, the other end thereof being formed with a second connection hole;

two second core shafts, one end section of one of said second core shafts being mounted in said second connection hole, thereby enabling said mentioned second core shaft and said first core shaft to synchronously rotate;

a frame, two sides thereof being respectively formed with a frame arm, each of said second core shafts being respectively and axially fastened on each distal piece of said frame arm, thereby enabling said two second core shafts to synchronously rotate;

two brake mechanisms, each of said brake mechanisms being sleeved on each of said second core shafts and including a fixed cam not rotated with said second core shaft, a mobile cam rotated with said second core shaft and an elastic unit abutted against said mobile cam for being operated coordinately, so each of said mobile cams being affected by the viscous resistance for being smoothly rotated and displaced relative to each of said fixed cams or being smoothly and automatically engaged with each of said fixed cams; and two supporters, each of said two second core shafts being respectively passed and installed on each of said supporters, so each of said supporters being respectively pivoted with each of said distal pieces of said frame arms, thereby enabling said frame to be smoothly and automatically rotated and unfolded till being positioned or smoothly rotated for being engaged.

12. The damping hinge device as claimed in claim 11, wherein said damping contact part of said first core shaft is formed in a columnar shape, said connection part of said first core shaft and said second core shaft are both formed in a non-columnar shape, said second connection hole and said first connection hole are both formed in a non-circular shape and located at the same axial line, thereby allowing said first core shaft and said second core shaft to be coaxially arranged.

13. The damping hinge device as claimed in claim 11, wherein said accommodation part is formed with an opening at the other end of said tubular body, said tubular body is provided with a fasten sheet at the location corresponding to said opening, said second connection hole is formed on said fasten sheet; each of said supporters is respectively formed with two pivotal parts, each of second core shafts is respectively passed and installed in said two pivotal parts of each of said supporters and in said fixed cam, said mobile cam and said elastic unit disposed between said two pivotal parts.

14. The damping hinge device as claimed in claim 13, wherein each of said fixed cams is respectively fastened on one of said pivotal parts of each of said supporters, the other pivotal part of each of said supporters is respectively stacked with at least a friction pad formed with a non-circular hole, each of said elastic units is respectively disposed between each of said friction pads and each of said mobile cams, each of said second core shafts is respectively passed said non-circular hole of each of said friction pads, and one end section of each of said second core shafts is respectively provided with a position adjusting member, wherein the mentioned end section of one of said second core shafts is passed said second connection hole thereby allowing said position adjusting member to be disposed in said accommodation part and abutted against one side of said fasten sheet, an elastic disk is disposed between the opposite side of said fasten sheet and the other pivotal part of said supporter thereby allowing said connection member to be adjustably positioned on said second core shaft, and each of said elastic units includes a first spring sleeved on said second core shaft and a second spring having said first spring sleeved therein.

15. The damping hinge device as claimed in claim 11, wherein one end section of said core shaft sleeve is further symmetrically provided with another core shaft sleeve having the same structure, another first core shaft, another first ring, another second ring and another connection member, so each of said two second core shafts is respectively mounted with each of said connection members and coaxially arranged with each of said first core shafts.

16. The damping hinge device as claimed in claim 11, wherein a positioning part used for positioning said second ring is formed between said connection part and said damping contact part of said first core shaft, said positioning part is concavely formed with a positioning groove used for positioning said first ring, said slot opening of said accommodation slot of said core shaft sleeve is formed with an annular slot, the inner edge of said second ring is formed with an annular flange mounted in said annular slot and covered said first ring.

17. The damping hinge device as claimed in claim 11, wherein said at least one groove of said first core shaft is formed as a spiral groove surrounding the peripheral surface of said damping contact part; the other end section of said first core shaft is axially extended with a convex column, an inner bottom surface of said accommodation slot of said core shaft sleeve is formed with a concave slot axially connected said convex column; the periphery of said core shaft sleeve is radially formed with at least a fasten structure.

* * * * *